United States Patent [19]

Takahashi

[11] 4,416,623

[45] Nov. 22, 1983

[54] MUFFLE FURNACE

[75] Inventor: Susumu Takahashi, Yokohama, Japan

[73] Assignee: Kanto Yakin Kogyo Kabushiki Kaisha, Tokyo, Japan

[21] Appl. No.: 344,603

[22] Filed: Feb. 1, 1982

[51] Int. Cl.[3] ..... F27B 1/26; F27B 5/14; F27D 11/00

[52] U.S. Cl. ..... 432/36; 219/390; 373/111; 432/153

[58] Field of Search ..... 432/36, 153; 373/111; 219/388, 395; 219/390

[56] References Cited

U.S. PATENT DOCUMENTS 2,783,987 3/1957 Gilbert ..... 432/153
4,371,246 1/1983 Siryj ..... 219/388

*Primary Examiner*—John J. Camby
*Attorney, Agent, or Firm*—Shlesinger, Fitzsimmons & Shlesinger

[57] ABSTRACT

Muffle furnace having an elongated metallic muffle extending through several heating zones of the furnace. Temperature of muffle is measured at different parts thereof. In order to minimize the difference of temperature which causes the deformation of muffle, heaters of furnace are controlled coincidentally so as to compensate said difference.

4 Claims, 2 Drawing Figures

MUFFLE FURNACE

BRIEF SUMMARY OF THE INVENTION

This invention relates to a tunnel type heating furnace provided with an elongated metallic muffle, and more particularly it relates to a muffle furnace in which provisions are made to prevent the deformation or warp of muffle.

Various gases are employed as an atomophere of furnaces for the deoxidation or oxygen free heating of articles in the furnaces. In order to keep the atmosphere at a high purity, metallic muffles are often used. However, such muffles which are elongated and extend sometimes as long as 10 m, are apt to warp on account of differences of temperature produced among different portions thereof and especially between upper and lower portions with the elevation of temperature at their cyclic first operations and with the repeated introduction of articles thereinto. This warp or deformation adversely affects the normal operation of furnaces.

Hence, an object of this invention is to provide a muffle furnace in which the metallic muffle shall not be deformed, and by which articles in the furnace can be uniformly heated. It is known for those skilled in this art to control a temperature of metallic muffles in a heating furnace under a predetermined temperature by means of programmed heating. This conventional method can not, however, prevent the deformation of the muffles, because while it can make the muffles be subjected to a certain temperature as a whole, it can not prevent difference of temperatures existing among different portions of muffles.

Whereas, in this invention, a muffle which is heated by a plurality of heaters is checked continuously as to its temperature at several different portions thereof, and the muffle is continuously kept at a predetermined temperature or temperatures corresponding to those existing at one or more of said several portions, while the temperatures of other portions are controlled so as to be substantially equal to said predetermined temperature(s).

It shall be noted that said predetermined temperatures can be varied as one desires, whereby the muffle can be heated to any desired temperature, and that temperatures working at the muffle are substantially equal at any portion thereof, whereby muffles shall not be deformed, resulting in the smooth operation and running of a furnace.

DETAILED DESCRIPTION OF THE INVENTION

Figure 1:
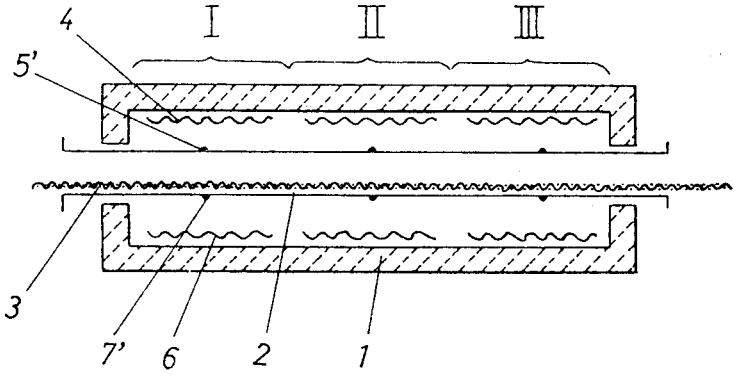
FIG. 1 is an explanatory sectional view of a muffle furnace made in accordance with this invention.
Figure 2:
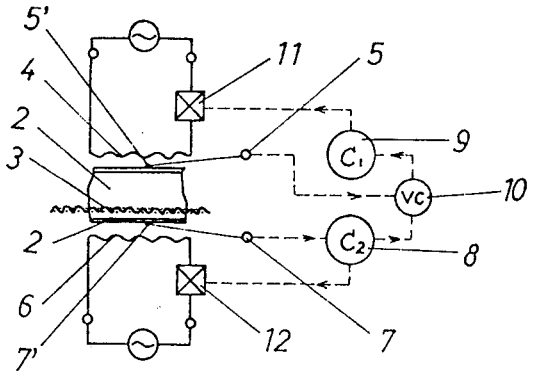
FIG. 2 is a part of the muffle with an example of wiring diagram for controlling the temperature of the muffle.

With reference to the drawing, a preferred embodiment of this invention is explained hereinunder more in detail.

A gas atmosphere heating furnace 1 which is provided with an elongated metallic muffle 2 extending through the furnace coaxially therewith and which is provided with a mesh belt conveyor 3 running through the muffle 2, are divided to a plurality of heating zones, viz., zones I, II, and III as illustrated in FIG. 1. Each zones is heated by independent heating means. And, each independent heating means a pair of opposed heaters such as a heater 4 which is located above the muffle 2 in the zone I, and another heater 6 which is located below the muffle 2 in the same zone I. Said upper heater 4 is controlled of its operation by a thermocouple 5 having its temperature sensing point 5' which is located at an upper part of muffle 2 in the zone I, while the said lower heater 6 is controlled by a thermocouple 7 through its temperature measuring point 7' located at a lower part of muffle 2.

The zones II and III have structures same to but independent from those of the zone I.

With regard to the zone I only, explanations are made in the following in order to simplify the description.

Heaters 4 and 6 heat the zone I, whereby the muffle 2 in the zone I is heated. The heater 6 continues to work until the muffle 2 in the zone I reaches a temperature set by a temperature controller 8. The differences in the temperatures sensed by the thermocouples 5 and 7 is determined by temperature detecting and setting means 10. The said difference of temperature thus obtained is applied to a temperature controller 9 for the heater 4. Numerals 11, 12 are electric current adjusters. The adjuster 12 is operable directly in accordance with the controller 8 which is settable as one desires, while the adjuster 11 is operated by the controller 9 via the means 10 which is in turn controlled by the controller 8 and the thermocouple 5.

Thus, always in response to the temperature of muffle 2 which is measured at the point 7', the temperature of muffle 2 at the point 5' is elevated or lowered, whereby the lower and upper parts of muffle are kept at the same temperature and whereby the deformation of the muffle on account of a difference of temperature is well prevented. By changing the wiring, the lower part of muffle can be heated in accordance with a predetermined temperature of the upper part of the muffle, likewise.

In an experience of this invention, in which the zone I was set to 400° C., the zone II to 500° C., and the zone III to 600° C., the difference of temperature at the lower and upper part of each zones of the muffle was as small as 2° C. The deformation of the muffle was negligible. And, the articles which were passed through the furnace, had less than 2° C. of difference of temperatures at their upper and lower surfaces.

What is claimed is:

1. In a muffle furnace in which a plurality of successive heating zones are provided along the length of an elongate, metallic muffle which extends longitudinally through said heating zones, the improvement comprising a pair of spaced, independently operable heaters provided in each of said heating zones adjacent the upper and lower sides, respectively, of said muffle, a pair of temperature sensors mounted on said upper and lower sides, respectively, of said muffle in each of said zones, means for operating one of said heaters in each of said zones until a predetermined temperature is detected by one of the corresponding pair of sensors in the associated zone, and means for controlling the operation of the other of said heaters in each zone to minimize the difference in temperatures detected by the corresponding pair of sensors in the associated zone.

2. A muffle furnace as defined in claim 1, wherein said operating means includes presettable temperature control means for selecting the desired, predetermined temperature to which one of said upper and lower surfaces, respectively, of said muffle is to be heated by said one heater in each zone, and means responsive to said presettable means for adjusting the operation of said one heater in a respective zone when said one surface in the last-named zone reaches said predetermined temperature.

3. A muffle furnace as defined in claim 2, wherein said controlling means includes means for determining for each zone the difference in temperatures sensed by the pair of sensors associated with a given zone, and means for each zone responsive to the temperature difference, as determined by the last-named means, to adjust the operation of said other heater for the associated zone, thereby to maintain as equal as possible the temperatures of said upper and lower sides of the muffle in each zone.

4. A muffle furnace as defined in claim 3, wherein said one heater is located adjacent said lower muffle surface in each zone, and said other heater is located adjacent said upper surface in each zone.

* * * * *